US005178490A

United States Patent [19]

Snowberger et al.

[11] Patent Number: 5,178,490

[45] Date of Patent: Jan. 12, 1993

[54] WICKET DAM LIFTING MODULE

[75] Inventors: Ralph B. Snowberger, Louisville, Ky.; Rick W. Schultz, New Albany, Ind.

[73] Assignee: The United States of America as represented by the Secretary of the Army, Washington, D.C.

[21] Appl. No.: 908,275

[22] Filed: Jul. 2, 1992

[51] Int. Cl.[5] ..... E02B 7/40

[52] U.S. Cl. ..... 405/102; 405/87; 405/100; 405/99

[58] Field of Search ..... 405/114, 87, 94, 100, 405/101, 102, 92

[56] References Cited

U.S. PATENT DOCUMENTS 419,287 1/1890 Scaife ..... 405/102

2,335,327 11/1943 Wellons ..... 405/102

3,718,002 2/1973 Aubert ..... 405/102

3,775,983 12/1973 Aubert ..... 405/102

4,352,592 10/1982 Aubert ..... 405/102

*Primary Examiner*—Dennis L. Taylor

*Attorney, Agent, or Firm*—Darrell E. Hollis

[57] ABSTRACT

In one embodiment, the invention is directed to a hydraulic lifting module which is removable as a unit from a wicket dam. A hydraulic cylinder is pivotably mounted about an axis in the frame and extends outwardly of an apertured cover between extreme positions. A slidable shield is secured and is pivotable with a portion of the cylinder extending out of the cover for closing the aperture and the extreme positions of the cylinder. A flexible boot interior of the frame renders the housing water and silt resistant.

18 Claims, 5 Drawing Sheets 41
109
172
170
106
168
38
108
168
32
126
128
34
134
130
120
120R
133
102
36
30
191
16
192
190
104
100
137
138
39
96
94
92
90
140
142
150
144
152
174
176
182'
184
160
180
162
164
120F
124
126
128
130

EL. 254
22
20
36
32
60
122
32
194
193
10
16
191
30
60
16
12
14
196
204
32'
200
EL. 300

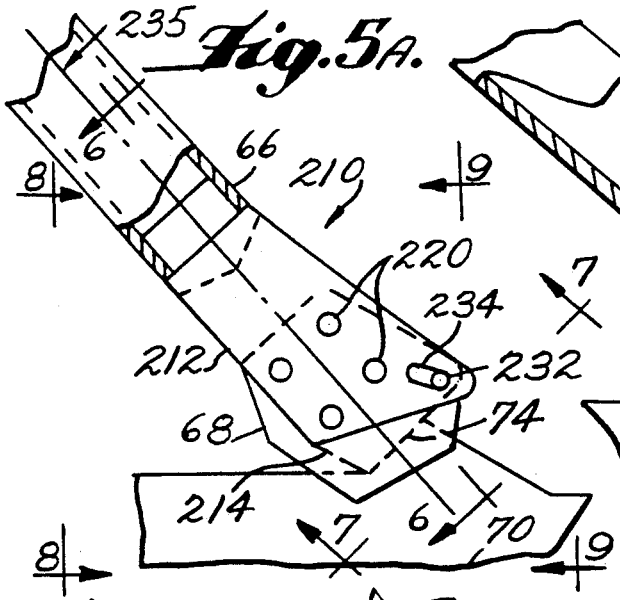
Fig. 5A.
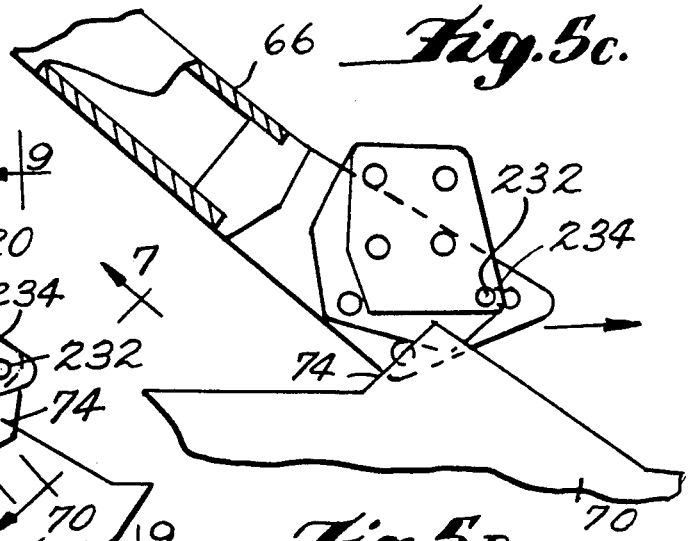
Fig. 5C.
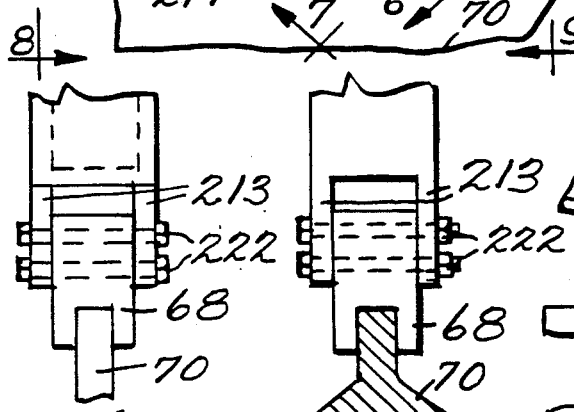
Fig. 8.
Fig. 7.
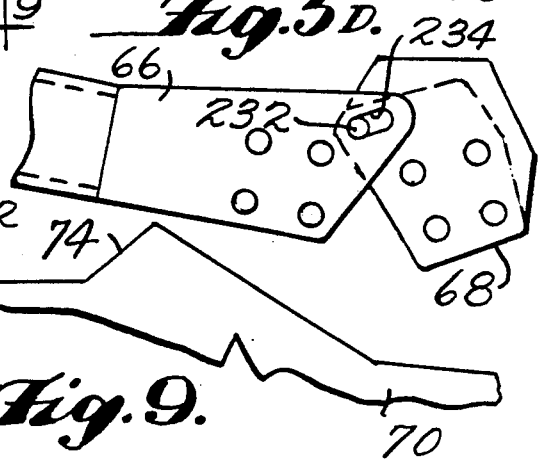
Fig. 5D.
Fig. 9.
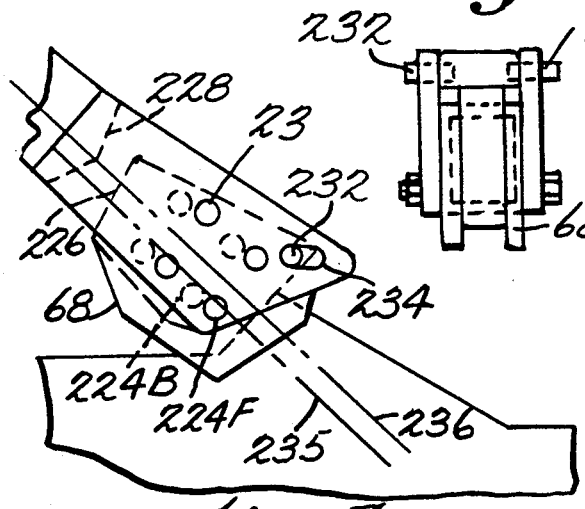
Fig. 5B.
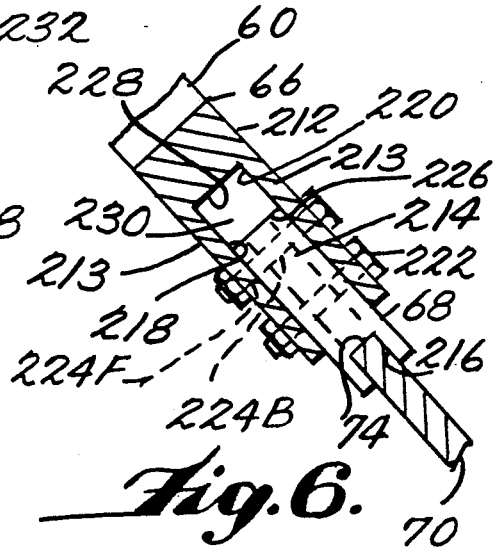
Fig. 6.

WICKET DAM LIFTING MODULE

BACKGROUND OF THE INVENTION

This invention relates to a wicket dam lifting assembly and in particular, the invention relates to a removable hydraulic lifting module for a wicket dam which is removably mounted as a unit from the wet cylinder chamber in the sill.

This invention relates to a wicket dam assembly, and, in particular, to an apparatus for aligning the lifting cylinder and the wicket.

This invention relates to a wicket dam assembly, and, in particular to a prop for supporting the wicket having a weak link for facilitating a controlled failure under excessive loads.

Wicket dams are employed to establish and maintain the height of navigable waterways. Such dams operate by moving wickets or gates to an elevated position, the upper end of which establishes the minimum height of the waterway. Vessels are moved around the dam by means of a system of locks. When the water level is high as in times of Spring runoff and heavy rain, the level of the waterway is sometimes raised to the level of the upper edge of the wicket. Under such circumstances, the wicket gate is retracted and traffic bypasses the locks.

A gate is a hinged structure which is pivoted between retracted and elevated positions at the upper end of the dam spillway or sill. In its retracted position, the wicket lies generally horizontally along the river bottom or sill. In its elevated position, the wicket is disposed near the vertical at an angle of about 65° to 70°.

A lifting mechanism in the form of a hydraulic lifting cylinder engages a bearing on the back side of the gate to lift it into position. Known lifting mechanisms for relatively small wicket dams employ a hydraulic cylinder which is pivotable about an axis parallel to the spillway and the pivot axis of the gate. The method for raising such a wicket uses a lifting cylinder oriented at an angle so that the bearing or lifting point is always in line with the piston rod once the wicket is set in its raised position. However, in large constructions, such known arrangements do not provide sufficient maneuverability for the hydraulic lift cylinder. Thus, the size of the wicket which can be lifted is limited. In addition, the known design has a problem, such that, if the wicket should for some reason lower prematurely, the piston rod would not be in alignment and the wicket could not be easily raised. Under such circumstances, an auxiliary lifting means, such as a lifting barge upstream of the dam, is required to reposition the wicket.

It is inevitable that repair and maintenance of the lifting cylinder is required on a periodic basis. Thus, if repairs cannot be effected quickly at the site, removal of the equipment is necessary. In known arrangements, the cylinder must be partially or fully disassembled if it is to be removed from the site. Such disassembly often requires opening of hydraulic lines in the wet cylinder chamber below the dam sill which is difficult. The known arrangements are therefore difficult to maintain and repair. Further, because the environment presents a danger to repair crews working on the sill, it is desirable to remove the equipment for repair or maintenance at a site remote from the dam. Presently, there is no means available to quickly remove and replace the hydraulic lifting system from the sill.

The lifting cylinder is in a harsh environment subject to damage from falling debris and silt carried by the waterway. Accordingly, protection for the lifting cylinder mechanism is desirable.

Wickets are held aloft by a device known as a prop. The prop is typically hinged to the back side of the wicket and the prop rotates about an axis parallel to the gate axis. The free end of the prop rides along a track guide known as a hurter on the sill floor. When the gate is lifted from the retracted, horizontal position, the prop slides along the hurter until it engages a check point or bearing against which it rests. The wicket may be lowered by lifting it to raise the wicket further and thereby release the prop in a known manner.

The prop structure is susceptible to damage when overloaded. If a large vessel, such as a loose barge, moves against the wicket, the prop will break away. Under such circumstances, damage to the wicket and the prop can be considerable. Realizing that the prop may be overloaded, it is desirable to provide a weak point in the prop which will fail in a controlled manner and which is more easily repaired.

SUMMARY OF THE INVENTION

The invention is designed to overcome and obviate the various shortcomings and limitations of the described prior arrangements. In one embodiment, the invention comprises a removable hydraulic lifting module for a wicket gate pivotable about a wicket axis. The module is removably mounted in a support having an open top. The support is embedded in a lift cylinder chamber in the sill of the dam. The module is formed of an enclosed frame having an open bottom portion and is positionable in the open top of the support. An apertured cover is secured to the frame about an upper margin thereof enclosing the frame. A hydraulic lifting cylinder is pivotably mounted about an axis in the frame. The cylinder extends outwardly of the apertured cover and the open bottom and is pivotable between extreme positions. A slidable shield is secured and is pivotable with a portion of the lifting cylinder extending out of the cover for enclosing the aperture and the cover between the extreme positions of the cylinder. Means coupled to the frame is provided for facilitating removal of the frame and the lift cylinder from the support as a unit.

The frame has an apertured domed cover through which the cylinder extends, and the cylinder carries a cover which is slidable over the dome for protecting the cylinder from debris. A flexible boot is secured between the dome and the cylinder for sealing interior portions of the cylinder from the exterior environment.

DESCRIPTION OF THE DRAWINGS

FIGS. 5A-5D are fragmentary side views of a prop having a pivotable breakaway bearing in accordance with the present invention;

FIG. 6 is a sectional view taken along line 6—6 of FIG. 5A;

FIG. 7 is a sectional view taken along line 7—7 of FIG. 5A;

FIG. 8 is a partial sectional view taken along line 8—8 of FIG. 5A; and

FIG. 9 is an end view in partial section taken along line 9—9 of FIG. 5A.

DESCRIPTION OF THE PREFERRED EMBODIMENTS

Figure 1:
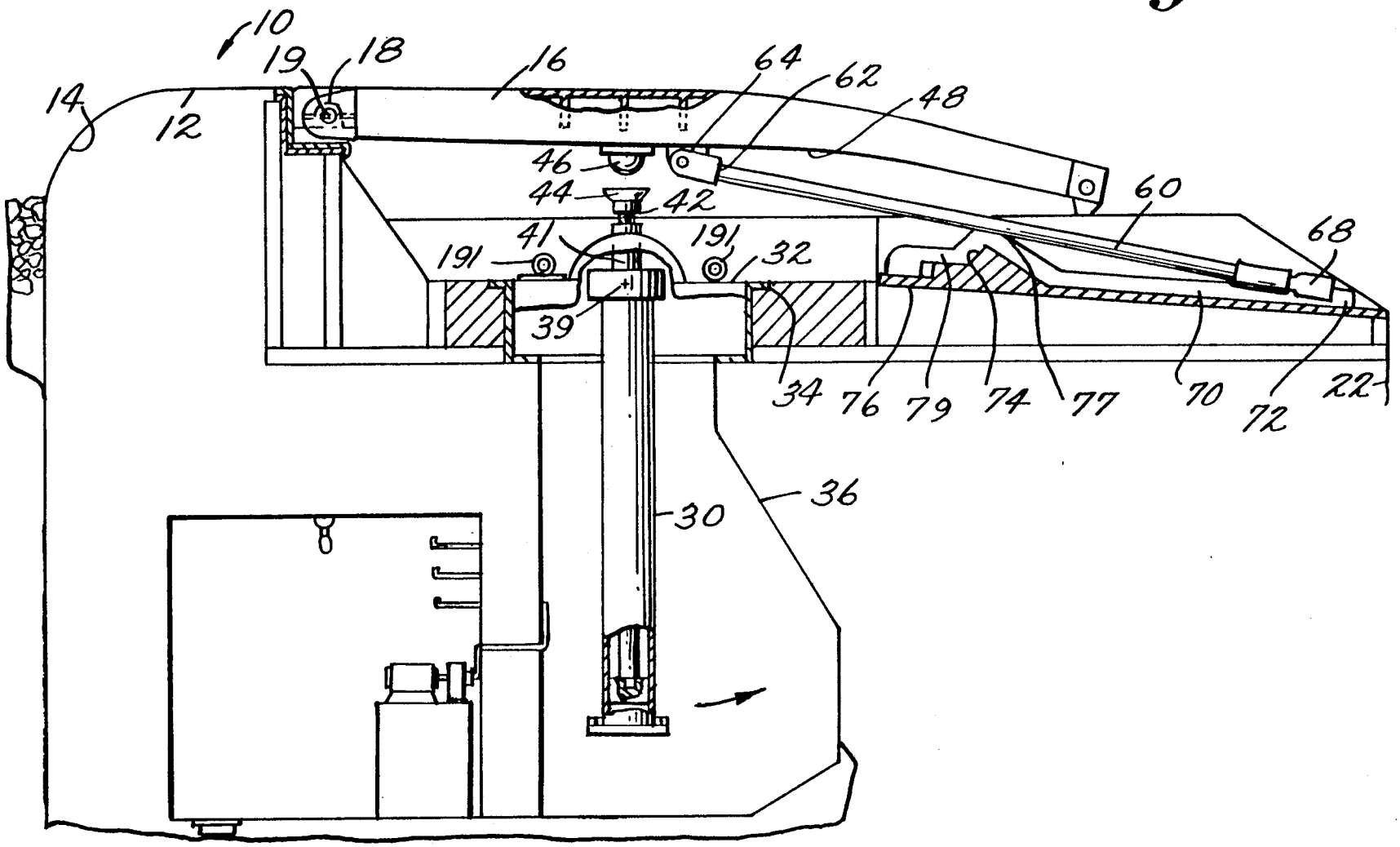
FIG. 1 is a schematic side sectional view of a wicket dam employing an alignable hydraulic lifting cylinder module in accordance with the present invention with the wicket retracted.
Figure 2:
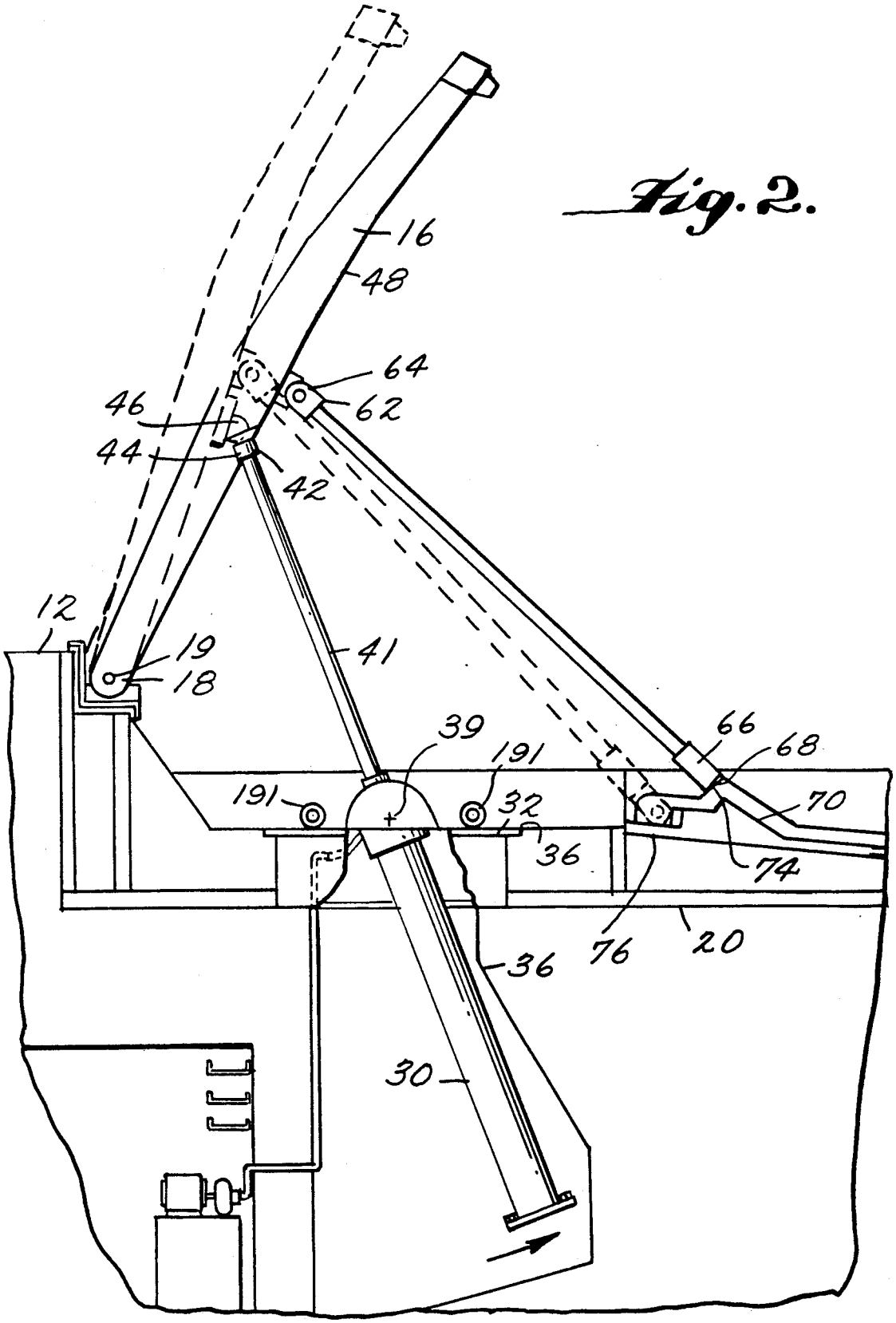
FIG. 2 is similar to FIG. 1 but with the wicket shown in the elevated position in solid lines and with the wicket shown raised further to the release position in phantom view.

FIGS. 1 and 2 generally illustrate an arrangement employing an apparatus in accordance with various aspects of the present invention. In FIGS. 1 and 2, a wicket dam 10 is generally illustrated. The dam 10 includes an upstream sill 12 on the high water or upstream side 14 of the sill. A wicket gate 16 is pivotably mounted to the sill by means of a gate hinge 18. The gate hinge 18 lies on an axis 19 parallel with the dam 10.

The dam 10 includes a downstream sill portion 20 located on the downstream side 22. The downstream sill 20 is stepped and is lower than the upstream sill 12.

The gate 16 is operative between a lower retracted position (FIG. 1) and an upper or raised position (FIG. 2 solid lines). The gate 16 is raised or lowered by means of a hydraulic lift cylinder 30 (FIG. 3) which is secured in a frame 32 supported in an open upper end 34 of a hydraulic cylinder chamber 36. The cylinder 30 is pivotably supported in the frame 32 by means of a trunion bearing 38 which allows the cylinder 30 to rotate about trunion axis 39 which is parallel to the axis 19 of the hinge 18.

The cylinder 30 has an extendable piston rod 41 and an upper free end 42 of which carries a separable cup bearing 44. The gate 16 carries a spherical wicket bearing 46 which is mounted to a rear side 48 of the wicket 16. In the position shown in FIG. 1, when the rod 41 is retracted and the wicket 16 is down, as shown, the cup bearing 44 is spaced from but aligned with the spherical bearing 46. As the rod 41 is extended, as shown in FIG. 2, cup bearing 44 engages the spherical bearing 46 and the cylinder 30 rotates about axis 39 of the trunion bearing 38 as the gate 16 is lifted. It should be understood that the weight of the gate 16 is sufficient to cause the cup bearing 44 and the spherical bearing 46 to engage with sufficient force so that the cylinder 30 follows the gate 16 as illustrated.

A prop 60 is hinged at one end 62 to the rear side 48 of the gate 16 by means of a pin or clevis bearing 64. The prop 60 has a free end 66 which carries a slotted bearing 68. The slotted bearing 68 rides in a hurter 70 which is supported on the downstream sill 20, as illustrated.

The hurter 70 has a downstream end 72 wherein the prop 60 rests when the gate 16 is down, as illustrated in FIG. 1. The hurter 70 also has a prop bearing 74 located at an upstream end 76. The hurter 70 has a cam surface 77 downstream of the hurter bearing 74. The hurter 70 also has a hurter switch 79 upstream of the hurter bearing 74. When the gate 16 is lifted to the upright position, as illustrated in FIG. 2, the slotted bearing 68 rides along the hurter 70 and over the cam surface 74, whereupon the prop bearing 68 engages the hurter bearing 74. In the embodiment shown, the prop bearing 68 drops into a locking, position to thereby support the gate 16 against its own weight and the force of any water on the upstream side 12 of the dam 10.

As shown in FIG. 2, when it is desired to lower the gate 16, the cylinder 30 is rotated by cylinder 90. Then rod 41 is extended and the cylinder 30 is caused, as hereinafter described, to align the cup bearing 44 with the spherical bearing 46. The rod 41 is further extended to thereby move the gate 16 to a release position (shown in phantom lines in FIG. 2), slightly above the raised position (shown in solid line in FIG. 2). In the release position, the prop bearing 68 moves further upstream and engages the hurter switch 79. As the rod 41 is retracted, the prop bearing 68 is caused by the switch 79 to ride around the hurter bearing 74 towards the downstream position 72 of the hurter 70 whereby the gate 16 is lowered as shown in FIG. 1.

Figure 3:
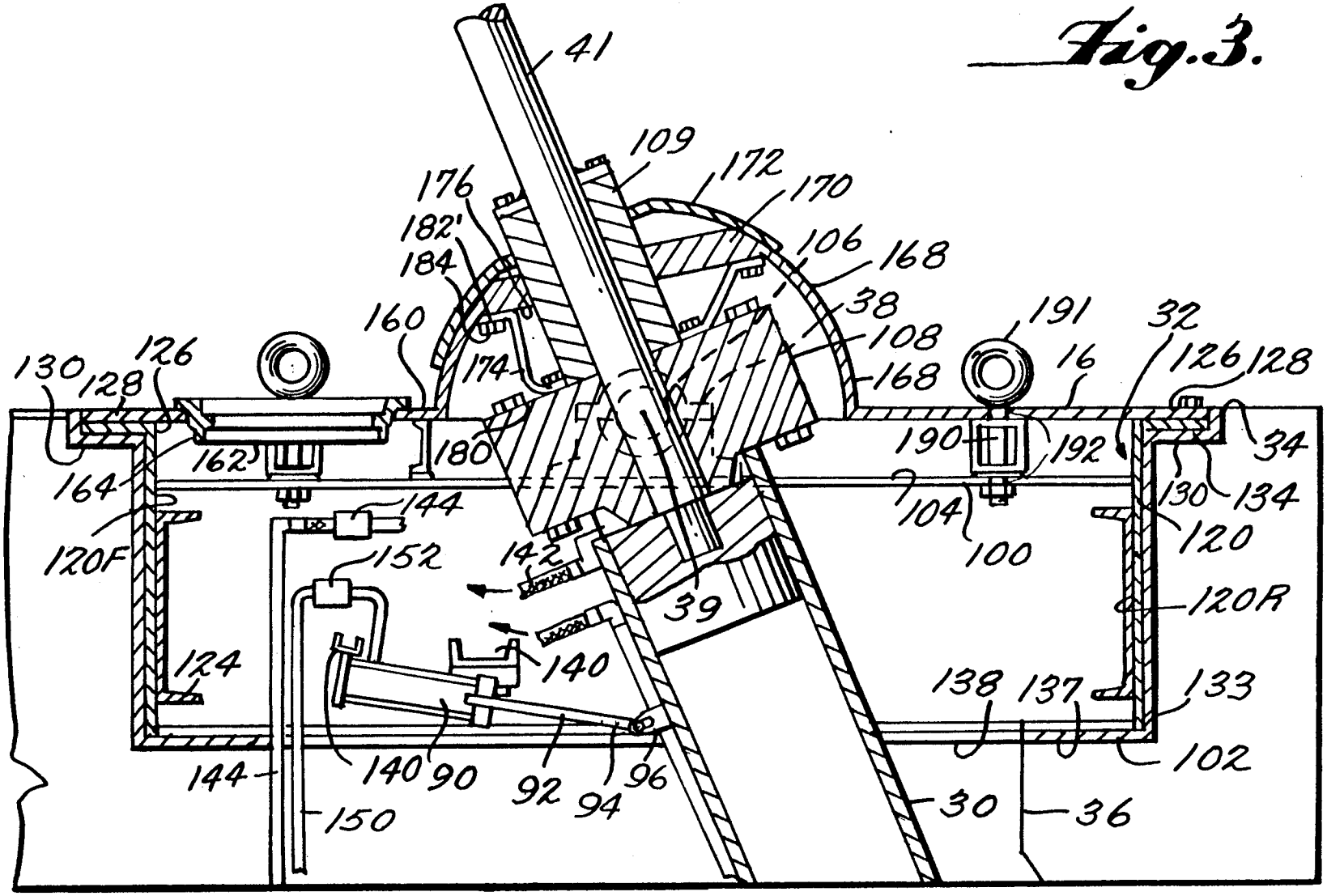
FIG. 3 is a side sectional view showing details of the lifting cylinder module shown in FIGS. 1 and 2.

In accordance with one aspect of the invention shown in FIG. 3, an alignment cylinder 90 is secured in the frame 32. The alignment cylinder 90 has a piston rod 92 which has a movable end 94 pivotably attached to the cylinder 30. In the arrangement illustrated, the moveable end 94 of the piston rod 92 is secured to the outside wall of the cylinder 30 by a clevis 96, as illustrated.

In accordance with the invention, after the gate 16 is raised to the elevated position (FIG. 2), the piston rod 41 is retracted and the cylinder 30 is positioned, generally by gravity to a vertical rest position (FIG. 1). When it is desired to release the gate 16, the rod 41 is raised and at the same time, the alignment cylinder piston rod 92 is extended causing the lifting cylinder 30 to rotate in the trunion bearing 38 counterclockwise so that the cup bearing 44 engages the spherical bearing 46. When so engaged, the piston rod 41 is further extended to cause release of the prop 60 as described above.

In accordance with another aspect of the invention, the lifting cylinder 30 is preferably formed as a modular, easily removable unit. Referring to FIG. 3, the frame 32, which supports the lifting cylinder 30, comprises a pair of spaced apart I beams 100 which rest on recessed ledges 102 in the upper end 34 of the cylinder chamber 36. The trunion bearings 38 rest, one each, on the upper surface 104 of the I beams 102. Shaft stubs 106 extend diametrically from the upper end 108 of the cylinder 30 and are secured in the circular openings of the trunion bearings 38.

The frame 34 further includes upstanding side wall portions 120 which form an open box-like structure 122. The I beams 100 are welded or secured to respective front and rear side walls 120F and 120R as illustrated. Lateral side walls 120L are secured to the front and rear side walls 120 F and 120R to form the box-like structure. C channel stiffeners 124 are secured between the I beams 100 and to the front and rear walls 120F and 120R of the frame 10 to form a rigid structure.

Upper margins 126 of the side walls 120 have flange portions 128 which rest in recesses 130 formed in the downstream sill 20. The recess 130 may be lined with a metal liner 132, as shown. Lower margins 133 of the side walls 120 engage the stepped portion 137 of the chamber opening 34. The frame 10 has an open bottom portion 138 which allows the cylinder 30 to swing between extreme positions.

A pair of cross members 140 are secured between the I beams 100 and carry the alignment cylinder 90 as illustrated. Flexible hydraulic lines 142 are coupled between the lifting cylinder and rigid hydraulic supply lines 144. The flexible lines 142 are coupled to the rigid lines 144 by quick disconnect couplers 146. Likewise, the alignment cylinder 90 has flexible hydraulic lines 148 coupled to rigid supply lines 150 by means of quick disconnect couplers 152.

The frame 10 has a sealed cover portion 160 which is secured to the flange portion 128 by suitable fasteners. The cover 160 has a watertight hatch 162 secured in an aperture 164. The hatch 162 is above the quick disconnects 146 and 152 and allows manual access thereto by maintenance personnel.

The cover 160 also has a domed portion 168 formed with a lateral slot 170 which is generally perpendicular to the gate axis 19. The upper end 108 of the lift cylinder 30 and the rod 41 extends through the slot 170 which is sufficiently elongated so that the cylinder may move between the extreme positions. A domed cover plate 172 is secured to an extension 109 of the upper end 108 of the cylinder 30 and matingly engages the domed portion 168 of the cover 160. The domed cover plate 172 covers the slot 170 as it slidably engages the domed portion 168 thereby shielding interior portions of the frame 32 from debris which may accumulate in and around the area of the downstream sill 20.

A flexible boot 174 is coupled between a lower side surface 176 of the domed portion 168 below the slot 172 and an upper wall portion 180 of the upper end 108 of cylinder 30. The boot 174 is secured by means of apertured rings 182 and a series of bolts 184. In accordance with this aspect of the invention, the cover plate 172 protects the interior of the module 10 from large debris and other objects. The plate 172, however, does not provide a watertight seal. Accordingly, the boot 174 prevents waterborne contamination including silt from entering the module.

Figure 4:
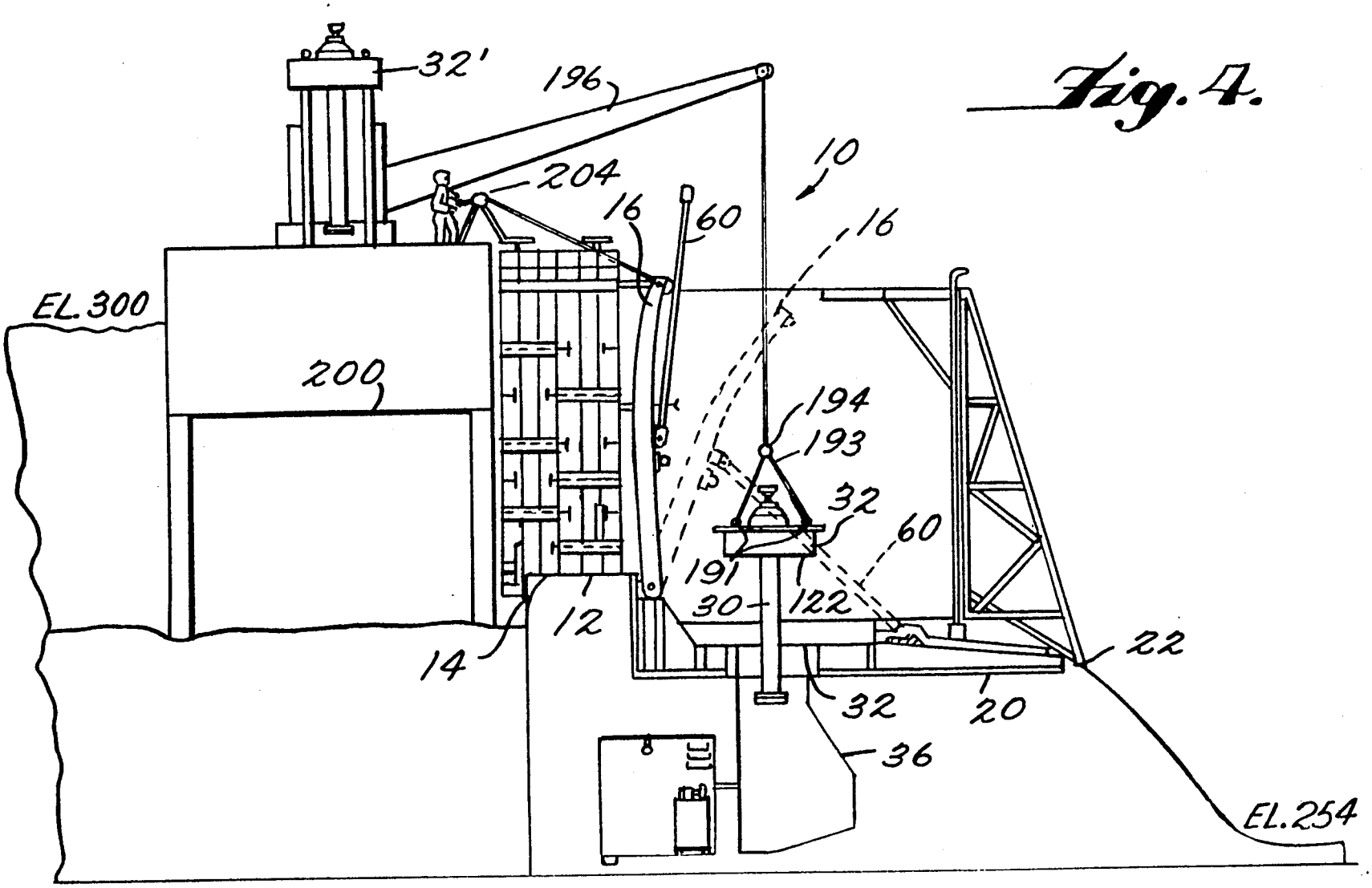
FIG. 4 is a side view similar to FIG. 1 with the wicket and prop raised to a vertical position and showing a work boat removing the lifting cylinder module.

Lifting bolts 190 with eyelet portions 191 are secured to the frame 32 through apertures 192 in the cover 160 and the upper side 104 of the I beams 100 as illustrated. As shown in FIG. 4, the eyelet portions 191 of the lifting bolts threaded with a cable 193 for engagement by the hook 194 of a crane 196 to lift the entire frame 32 including cylinder 30 out of the cylinder chamber 36. In the illustration, work boat 200 carries the crane 196 which reaches over the upstream side 12 of the dam 10. In the arrangement illustrated, the gate 16 is retracted to a full upright or vertical position by means of a wench 204. Also, the prop 60 is rotated out of the way and held in the vertical position.

In accordance with the invention, the entire frame 32 and lifting cylinder 30 are removable from the cylinder chamber 36 as a unit. It should be understood that prior to removal of the lifting module, the hatch 162 is opened and the quick disconnect couplers 146 and 152 are separated from the corresponding rigid lines 144 and 150.

As illustrated in FIG. 4, a spare module 32' may be installed in the chamber 34 and the gate 16 may be put back into service. A distinct advantage of the arrangement of the present invention is that repair work may be completed at another location remote from the site which is less hazardous to the work crews. Further, the work may be completed with less time pressure so that the quality of the repair and maintenance is, thereby enhanced.

In accordance with another aspect of the invention illustrated in FIGS. 5A-5D and 6-9, a weak link 210 for the prop 60 is provided. As illustrated, the free end 66 of the prop 60 carries the slotted bearing 68. The weak link 210 comprises a forked casting or fork 212 having parallel wall portions 213 (FIG. 6) which is located at the butt or free end 66 of the prop 60. The weak link 210 also includes a block casting 214 which is bolted to the fork 212 between the wall portions 213. As further shown in FIG. 6, the block 214 has a slot 216 which rides in the hurter 70. The block 214 may be a single casting or it may be formed of laminated plates.

The fork 212 has a slot 218 formed between opposing interior faces 220 of walls 213. The block 214 is secured in the slot 218 by at least one and preferably a plurality of shear bolts 222 which are located in corresponding aligned bolt holes 224F and 224B in the fork 212 and block 214. The bolt holes 224F and 224B are aligned with the force F exerted along the prop 60. As illustrated in FIGS. 2 and 5A, when the prop 60 is located against prop bearing 74, the gate 16 is secured in the upright position.

The block 214, secured in the slot 216 has a terminal end 226 which is separated by space 230 from a corresponding terminal end 228 of the fork 212. The space 230 allows the block 214 to move with respect to the fork 212 when an axial force F is exerted on the prop 60 which exceeds the shear strength of the bolts 222. In other words, if the force F exerted against the gate 16 exceeds the strength of the weak link 210, the shear bolts 222 fail and the bloc 214 is forced along the slot 218 in the fork 212.

The fork 212 has elongated slots 234 formed in the side wall portions 213. The slots 234 are not aligned with the force F exerted along the prop 60 but forward and upward. The block 214 has a pivot pin 232 which extends into and is slidable in the elongated slots 234. Thus, when the force F on the prop 60 exceeds the shear strength of the bolts 222, the bolts 222 fail and the block 214 moves forward towards the terminal end 226 of the block 214. The pivot pin 232, however, moves in the slot 230 and is not sheared. Instead, as the prop 60 moves toward block 214 in the direction of the force F along the axis of the prop 60, the slot 230 accommodates slidable motion pivot pin 232 and allows the block 214 to both slide askew of the prop 60 and rotate clockwise as the prop 60 rides past the hurter bearing 74.

An important feature of the invention is that the connection between the block 214 and the fork 212 requires the space 230 which thereby allows the thrust of the force F to drive the fork 212 for relative movement with respect to the block 214 to thereby allow the shear bolts 222 to fail. In accordance with another embodiment of the invention, a single shear bolt may be used, however, two or more are preferred for the loads on this application. In addition, other devices such as pins or dogs may be used to secure the block for relative motion with respect to the fork.

In accordance with the invention, if the prop 60 fails, it fails at a repairable weak link 210. The repair may be made by replacing the destroyed shear pins 222 at the site. The gate 16 may be then lifted and secured in the elevated position with the prop 60 relocated in the hurter 70.

While there have been described what at present are considered to be the preferred embodiments of the present invention, it will be readily apparent to those skilled in the art that various changes may be made therein without departing from the invention and it is intended in the claims to cover such changes and modifications as fall within the true spirit and scope of the invention.

What is claimed is:

1. A removable hydraulic lifting module for a wicket or gate pivotable about a wicket axis in a dam, said module being removably mounted in a support at an open top of a lift cylinder chamber in the sill of the dam comprising:

an enclosed frame having an open bottom portion and being positionable in the open top of the support;

an apertured cover secured to the frame about an upper margin enclosing the frame;

a hydraulic lift cylinder pivotably mounted about an axis in the frame and extending outwardly of the apertured cover in the open bottom and pivotable between extreme positions;

a slidable shield secured to and pivotable with the lift cylinder extending out of the cover for closing the aperture and the cover between the extreme positions of the lift cylinder;

means coupled to the frame for facilitating removal of the frame and cylinder from the support.

2. The apparatus according to claim 1, further including a hatch formed in the cover for accessing the frame.

3. The apparatus according to claim 1, further comprising an alignment cylinder secured to the frame and coupled to the lift cylinder for selectively rotating the lift cylinder between the extreme positions.

4. The apparatus according to claim 3, further comprising fluid supply means for the alignment cylinder and the lift cylinder including a quick disconnect coupler for separating the module from the cylinder chamber.

5. The apparatus according to claim 1, wherein the means coupled to the frame for facilitating removal of the module from the support comprises at least two eyelet secured to the frame.

6. The apparatus according to claim 1, wherein the frame comprises a pair of I beams in spaced relation and a pair of trunion bearings secured to upper surfaces of the I beams for support the lifting cylinder therein.

7. The apparatus according to claim 6, the frame further includes depending side walls surrounding the I beams forming an enclosure having an open bottom and top.

8. The apparatus according to claim 7, the frame further includes a flange portion located at an upper end of the side walls and being secured to the cover portion.

9. The apparatus according to claim 6, where the frame further includes stiffener means located at free ends of the I beams for establishing the spaced relation thereof, said I beams and stiffeners forming a rectangular structure.

10. The apparatus according to claim 1, wherein the apertured cover includes a dome portion for enclosing an upper end of the lift cylinder, said dome portion having a slot therein for accommodating the upper end of the lift cylinder for motion therein, said slot extending in a direction between the extreme positions of the lift cylinder.

11. The apparatus according to claim 10, further comprising a shield conforming to a portion of the dome, and being attached to the lift cylinder externally of the cover in mating relationship with the dome for closing the slot between the extreme positions of the lift cylinder.

12. The apparatus according to claim 1, further including a flexible boot secured between the dome and a portion of the lift cylinder internal of the cover.

13. The apparatus according to claim 12, wherein the boot comprises an annular member having an interior aperture sized for receiving the cylinder therein and an outer marginal edge extending around and beyond extreme ends of the slot.

14. The apparatus according to claim 13, further including ring means for securing the apertured portion of the boot to the cylinder and the outer marginal edge of the boot to the cover.

15. The apparatus according to claim 1, wherein the lift cylinder includes a piston rod axially movable in the cylinder between a retracted and a fully extended position, said piston rod having a free end for engaging a downstream side of the wicket; bearing means secured between the wicket and the piston rod for causing the cylinder to rotatably follow the wicket between the lower position and the extreme upright position.

16. The apparatus according to claim 15, wherein the bearing means includes cup bearing secured to the free end of the piston rod and a spherical bearing secured to the downstream side of the wicket, said cup bearing and spherical bearing being in axial alignment when the wicket is in the lower extreme position.

17. The apparatus according to claim 16, wherein the cup bearing and spherical bearing are in spaced apart relationship when the wicket is down, said cup bearing engaging the spherical bearing for raising the wicket upon activation of the lift cylinder, said lift cylinder being freely movable for rotating about an axis parallel to the wicket axis.

18. The apparatus according to claim 1, further including a prop secured to the downstream side of the wicket and having a free end slidable on the downstream side of the sill; and hurter means on the downstream side of the sill for engaging the free end of the prop between the extreme positions of the wicket, said hurter including a support bearing and said prop for engaging the support bearing as the wicket is raised to near the extreme upright position by the lift cylinder and further including release means adjacent the support bearing for releasing the prop as the gate is raised further to the extreme upright position whereby the prop releases the wicket as the lift cylinder is retracted.

* * * * *